US006173773B1

(12) United States Patent
Almaguer et al.

(10) Patent No.: US 6,173,773 B1
(45) Date of Patent: Jan. 16, 2001

(54) ORIENTING DOWNHOLE TOOLS

(75) Inventors: James S. Almaguer, Richmond; Thomas H. Zimmerman, Houston; Jorge E. Lopez de Cardenas, Sugar Land, all of TX (US)

(73) Assignee: Schlumberger Technology Corporation, Sugar Land, TX (US)

( * ) Notice: Under 35 U.S.C. 154(b), the term of this patent shall be extended for 0 days.

(21) Appl. No.: 09/292,151

(22) Filed: Apr. 15, 1999

Related U.S. Application Data

(60) Provisional application No. 60/082,052, filed on Apr. 16, 1998.

(51) Int. Cl.[7] ..... E21B 43/119; E21B 47/024

(52) U.S. Cl. ..... 166/255.2; 166/55.1; 166/66; 166/241.1; 166/297; 175/4.51

(58) Field of Search ..... 166/55.1, 66, 66.4, 166/241.1, 241.5, 255.2, 297, 298; 73/152.24; 175/4.51

(56) References Cited

U.S. PATENT DOCUMENTS

| | | | | |
|---|---|---|---|---|
| 3,104,709 | | 9/1963 | Kenneday et al. . | |
| 3,291,207 | | 12/1966 | Rike . | |
| 3,294,163 | | 12/1966 | LeBourg . | |
| 3,307,642 | | 3/1967 | Smith . | |
| 3,342,275 | | 9/1967 | Mellies . | |
| 3,704,749 | | 12/1972 | Estes et al. . | |
| 3,964,553 | | 6/1976 | Basham et al. . | |
| 4,109,717 | | 8/1978 | Cooke, Jr. . | |
| 4,393,946 | | 7/1983 | Pottier et al. . | |
| 4,410,051 | * | 10/1983 | Daniel et al. | 175/4.51 |
| 4,438,810 | | 3/1984 | Wilkinson . | |
| 4,637,478 | * | 1/1987 | George | 175/4.51 |
| 4,665,984 | | 5/1987 | Hayashi et al. . | |
| 4,694,754 | | 9/1987 | Dines et al. . | |
| 4,830,106 | | 5/1989 | Uhri . | |
| 4,951,744 | | 8/1990 | Rytlewski . | |
| 4,974,675 | | 12/1990 | Austin et al. . | |
| 4,977,961 | | 12/1990 | Avasthi . | |
| 5,005,643 | | 4/1991 | Soliman et al. . | |
| 5,010,964 | | 4/1991 | Cornette . | |
| 5,040,619 | | 8/1991 | Jordan et al. . | |
| 5,095,999 | | 3/1992 | Markel . | |
| 5,107,929 | | 4/1992 | Lopez de Cardenas | 166/297 |
| 5,111,881 | | 5/1992 | Soliman et al. | 166/297 X |
| 5,211,714 | | 5/1993 | Jordan et al. | 166/297 |
| 5,236,040 | | 8/1993 | Venditto et al. | 166/308 X |
| 5,259,466 | | 11/1993 | Venditto et al. | 166/297 X |

(List continued on next page.)

FOREIGN PATENT DOCUMENTS 0 452 126 A2 10/1991 (EP) .

OTHER PUBLICATIONS

C.H. Yew, et al., *SPE 19722*, Society of Pertroleum Engineers, pp. 211–224 (Copyrighted 1989).

L.A. Behrmann, et al., *Effect of Perforations on Fracture Initiation*, pp. 607–616 (May 1991).

Pat Finnegan, *Gun Orienting in Multiple Sring Completion*, The Perforating and Testing Review, vol. 6, No. 1, pp. 1–9 (Mar. 1993).

* cited by examiner

*Primary Examiner*—George Suchfield
(74) *Attorney, Agent, or Firm*—Trop, Pruner & Hu P.C.

(57) ABSTRACT

A method and apparatus of orienting a tool in a wellbore includes running an orientation string into the wellbore, the orienting string including a positioning device, a measurement device (e.g., a gyroscope), and the tool. The orientation string is positioned in a predetermined interval in the wellbore. The azimuthal orientation of the orientation string is measured with the measurement device. The orientation string is removed from the wellbore, and a tool string is run into the wellbore, the tool string including substantially similar components as the orientation string such that the tool string follows substantially the same path as the orientation string.

25 Claims, 5 Drawing Sheets

U.S. PATENT DOCUMENTS

| | | | | |
|---|---|---|---|---|
| 5,273,121 | * | 12/1993 | Kitney et al. | 166/55.1 X |
| 5,277,062 | | 1/1994 | Blauch et al. . | |
| 5,318,123 | | 6/1994 | Venditto et al. | 166/297 X |
| 5,335,724 | | 8/1994 | Venditto et al. | 166/298 |
| 5,421,418 | | 6/1995 | Nelson et al. | 166/297 X |
| 5,542,480 | | 8/1996 | Owen et al. | 175/4.51 |
| 5,590,723 | | 1/1997 | Walker et al. | 175/4.6 |
| 5,636,686 | * | 6/1997 | Witrisch | 166/66 |
| 5,701,964 | | 12/1997 | Walker et al. | 175/4.6 |
| 5,816,343 | | 10/1998 | Markel et al. | 175/4.51 |
| 5,964,294 | * | 10/1999 | Edwards et al. | 166/55.1 |
| 6,003,599 | * | 12/1999 | Huber et al. | 166/255.2- |

ORIENTING DOWNHOLE TOOLS

The present application claims priority under 35 U.S.C. § 119 to Provisional Application Ser. No. 60/082,052, filed Apr. 16, 1998, entitled "Oriented Wellbore Tools."

BACKGROUND

The invention relates to orienting downhole tools.

To complete a well, one or more formation zones adjacent a wellbore may be perforated to allow fluid from the formation zones to flow into the well for production to the surface. A perforating gun string may be lowered into the well and guns fired to create openings in casing and to extend perforations into the surrounding formation.

When performing downhole perforating operations in a wellbore, there may be a need to orient the perforating gun string. This need may arise, for example, if perforations are desired to be shot in alignment with a preferred fracture plane in the surrounding formation (e.g., generally normal to the minimum stress plane of the formation) to help in fracture stimulation of the well to improve well performance. By aligning perforations properly with respect to the preferred fracture plane, improved fluid flow occurs through the formations.

Other situations also exist in which oriented perforating or other downhole operations may be desirable. Thus, a need exists for improved mechanisms and techniques to orient perforating equipment or other downhole equipment in a wellbore.

SUMMARY

In general, in one embodiment, a method of orienting a tool in a wellbore includes identifying a desired orientation of an oriented device in the tool at a given wellbore interval. The oriented device is angularly positioned with respect to a positioning device, and a tool is lowered downhole with the positioning device guiding the tool so that the oriented device is at substantially the desired orientation when the tool reaches the given wellbore interval.

In general, in another embodiment, an apparatus for orienting a tool in a wellbore includes a motor coupled to the tool, an anchor to fix the apparatus in the wellbore, and a measurement device adapted to measure a relative bearing of the tool. The motor is activable to rotate the tool with respect to the anchor based on the relative bearing data received from the measurement device.

Other embodiments and features will become apparent from the following description and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. For example, although reference is made to perforating strings in some embodiments, it is contemplated that other types of oriented downhole tool strings may be included in further embodiments.

Figure 1:
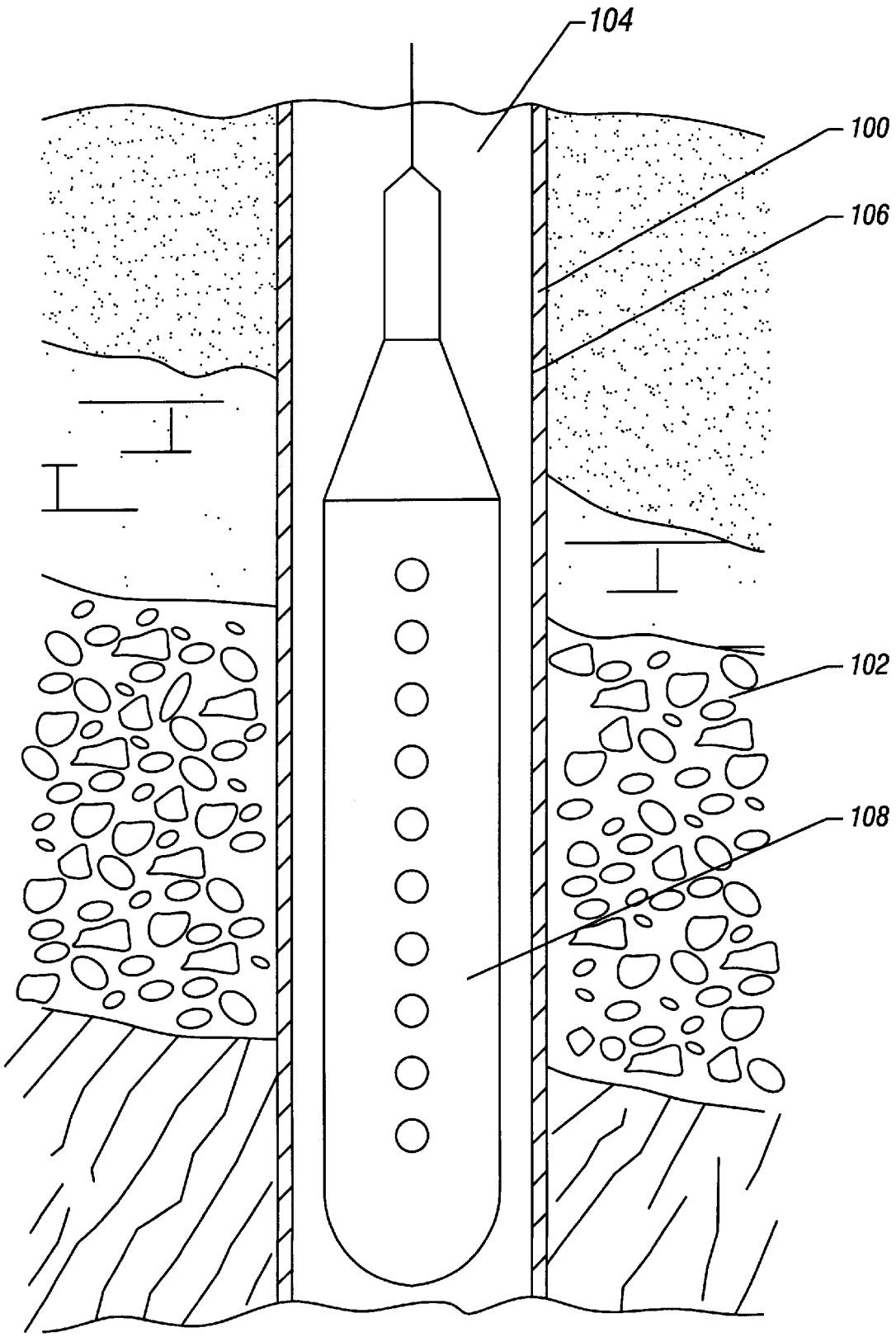
FIG. 1 is a diagram of an embodiment of a tool string positioned in a cased wellbore.

Referring to FIG. 1, a formation zone 102 having producible fluids is adjacent a wellbore 104 lined with casing 100. The location of the formation zone 102 and its stress characteristics (including the minimum and maximum stress planes) may be identified using any number of techniques, including open hole (OH) logging, dipole sonic imaging (DSI), ultrasonic borehole imaging (UBI), vertical seismic profiling (VSP), formation micro-imaging (FMI), or the Snider/Halco injection method (in which tracers are pumped into the formation 102 and a measurement tool is used to detect radioactivity to identify producible fluids).

Such logging techniques can measure the permeability of the formation 102. Based on such measurements, the depth of a zone containing producible fluids can be determined. Also, the desired or preferred fracture plane in the formation 102 can also be determined. The preferred fracture plane may be generally in the direction of maximum horizontal stresses in the formation 102. However, it is contemplated that a desired fracture plane may also be aligned at some predetermined angle with respect to the minimum or maximum stress plane. Once a desired fracture plane is known, oriented perforating equipment 108 may be lowered into the wellbore to create perforations that are aligned with the desired plane.

In another embodiment, oriented perforating may also be used to minimize sand production in weak formations. In addition, oriented perforating may be used to shoot away from other downhole equipment to prevent damage to the equipment, such as electrical cables, fiber optic lines, submersible pump cables, adjacent production tubing or injection pipe, and so forth. Oriented perforating may also be practiced for doing directional squeeze jobs. If the current surrounding the pipe contains a void channel, the direction of that channel can be determined using a variety of methods and tools such as the USIT (Ultrasonic Imaging Tool). Once the direction is known, oriented perforating may be executed accordingly. Further embodiments may include oriented downhole tools for other operations. For example, other downhole tools may perform oriented core sampling for formation analysis and for verification of a core's direction, for setting wireline-conveyed whipstocks, and for other operations.

With a vertical or near vertical wellbore 104 having a shallow angle of trajectory (e.g., less than about 10°), it may be difficult to use the force of gravity to adjust the azimuthal orientation of a perforating gun string or other tool string carried by a non-rigid carrier (e.g., wireline or slick line) from the surface. According to some embodiments of the invention, an oriented perforating string includes an orienting mechanism to orient the perforating string in a desired azimuthal direction. It is contemplated that some embodiments of the invention may also be used in inclined wellbores.

Several different embodiments of oriented perforating equipment are described below. In a first embodiment, a "natural orientation" technique is employed that is based on the principle that the path of travel and position of a given tool string (or of substantially similar strings) within a given section of a well is generally repeatable provided that steering effects from the cable (e.g., cable torque) are sufficiently eliminated (e.g., by using a cable swivel). It may also be necessary to keep most operational and tool conditions generally constant. Such conditions may include the following, for example: components in the tool string; length of tool string; method of positioning (e.g., lowering and raising) the tool string; and so forth. Thus, in the natural orientation technique, a first orientation string including a positioning device may be run in which a measurement device can determine the position and orientation of the string after it has reached its destination. The positioning device in one embodiment may be a mechanical device (e.g., including centralizing or eccentralizing arms, springs, or other components). In another embodiment, the positioning device may be an electrical or magnetic device. Once the natural orientation of the tool string is determined based on the first trip, the tool's angular position may be adjusted (rotated) at the well surface to the desired position. A second run with a tool string including a positioning device is then performed by lowering the tool string into the wellbore, which tends to follow generally the same path.

In a variation of this embodiment, it may be assumed that in wells that have sufficient inclination (e.g., perhaps about 2° or more), the positioning device will position the tool string at some relationship with respect to the high or low side of a wellbore once the tool string has been lowered to a predetermined depth. An oriented device in the tool string may then be angularly aligned at the surface before lowering into the wellbore so that the oriented device is at substantially a desired orientation once it is lowered to a given wellbore interval. In this variation, one run instead of two runs may be used.

In other embodiments, a motorized oriented tool string includes a motor and one or more orientation devices lowered into the wellbore, with the tool rotated to the desired azimuthal or gravitational orientation by the motor based on measurements made by the orientation devices.

Figure 2A:
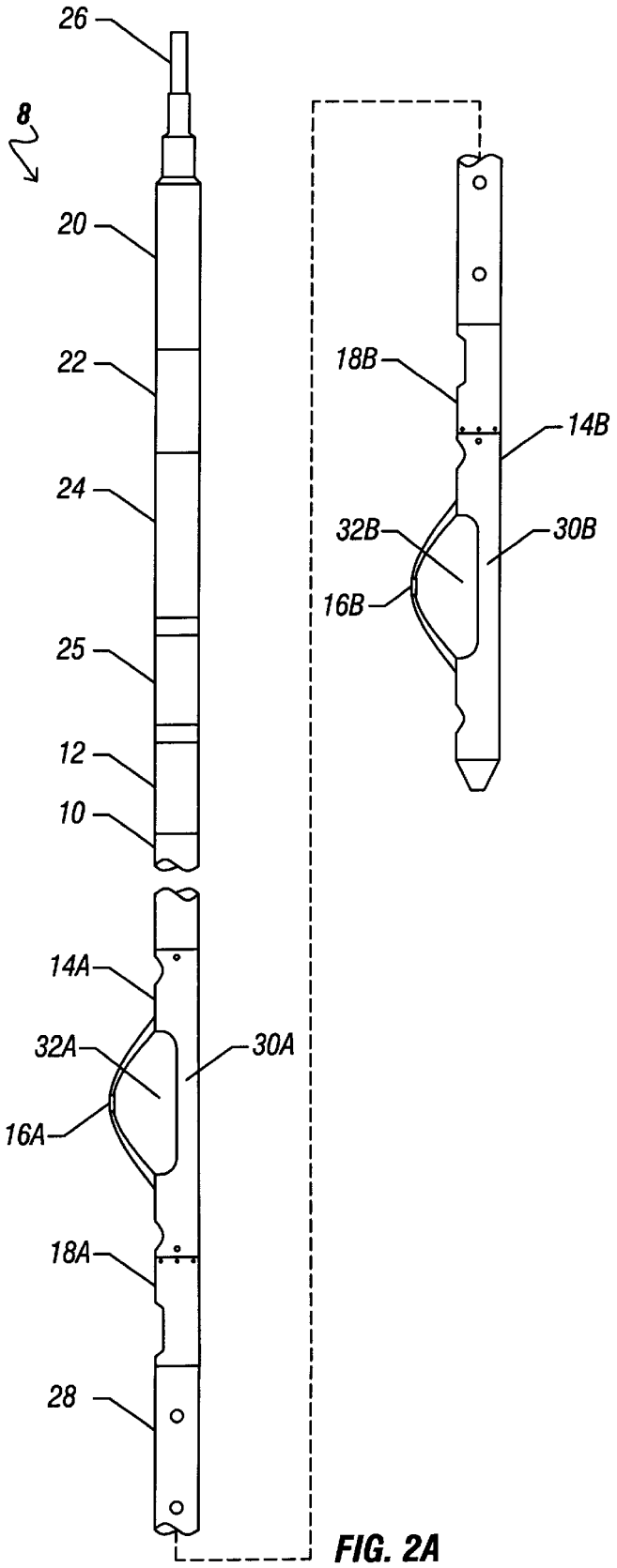
FIGS. 2A and 2B are diagrams of tool strings according to one embodiment used to perform natural orientation.
Figure 2B:
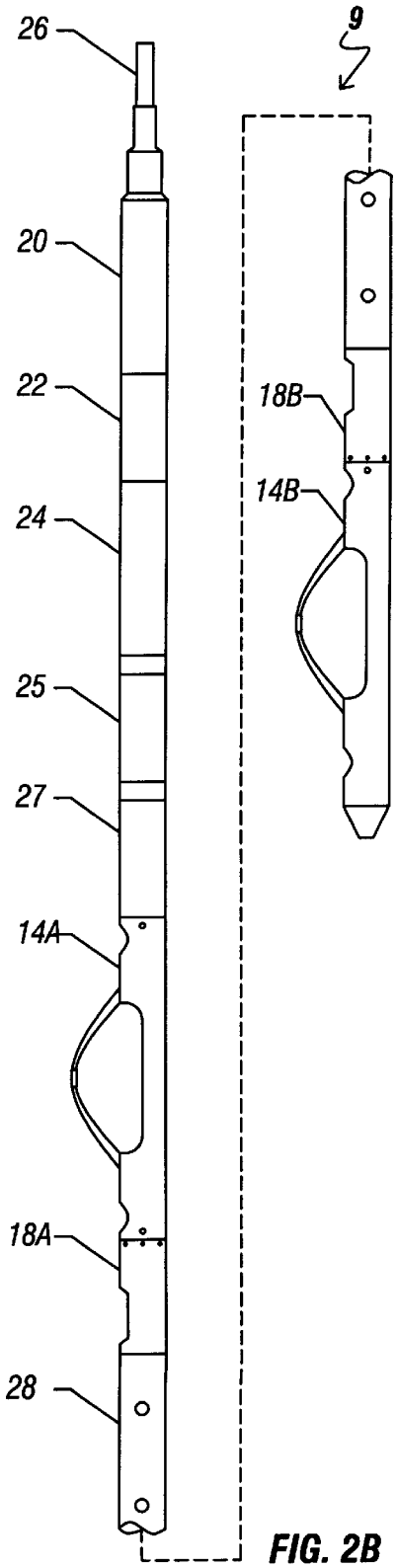

Referring to FIGS. 2A–2B, tools for performing natural orientation of downhole equipment (such as a perforating string) are shown. In one embodiment, natural orientation involves two runs into the wellbore 104. In another embodiment, natural orientation may involve one run into the wellbore. In the embodiment involving two runs, a first run includes lowering an orientation string 8 (FIG. 2A) into the wellbore to measure the orientation of the string 8. Once the orientation of the tool string 8 is determined based on the first trip, the device 28's angular position may be adjusted (rotated) with respect to the tool string 8 at the well surface to the desired position.

Next, a tool string 9 (FIG. 2B), which may be a perforating string, for example, is lowered downhole that follows substantially the same path as the orientation string 8 so that the tool string 9 ends up in substantially the same azimuthal position as the orientation string 8. Thus, the first trip is used for determining the natural orientation of the tool string 8 after it has reached a given interval (depth), while the second trip is for performing the intended operation (e.g., perforating) in that interval after the tool string 9 has been lowered to the given interval and positioned in substantially the same natural orientation.

On the first trip, a gyroscope device 10 may be included in the string 8 to measure the azimuthal orientation of the string in the wellbore interval of interest. An inclinometer tool 25 which can be used for providing the relative bearing of the orientation string 8 relative to the high side of the wellbore may also be included in the string. A few passes with the orientation string 8 can be made, with the relative bearing and azimuthal orientation information measured and stored in a log. Each pass may include lowering and raising the orientation tool string 8 one or more times. The tool positions for the up and down movements in a pass may be different. The direction (up or down) in which better repeatability may be achieved can be selected for positioning the tool.

The orientation string 8 and the tool string 9 are designed to include as many as the same components as possible so that the two strings will substantially follow the same path downhole in the wellbore. On the second trip, the gyroscope device 10 may be removed from the string 9, but the remaining components may remain the same. Next, the device (e.g., a perforating gun 28) in the tool string 9 for performing the desired operation is oriented, at the surface, to place the device at an angular position with respect to the rest of the string 8 based on the natural orientation determined in the first trip. Any special preparation such as arming guns may also be performed prior to re-entering the well for the second trip. The inclinometer tool 25 may remain in the tool string 9 to measure the relative bearing of the tool string 9 to determine if tool string 9 is following generally the same path as the orientation string 8.

Removal of the gyroscope device 10 is performed to reduce likelihood of damage to the gyroscope. However, with a gyroscope that is capable of withstanding the shock associated with activating a perforating gun 28, the gyroscope device 10 may be left in the string 9. Further, in oriented downhole tools that do not perform perforation, the gyroscope may be left in the tool string as the shock associated with perforating operations do not exist.

The gyroscope device 10 in the orientation string 8 is used to identify the azimuthal orientation of the string 8 with respect to true north. In one example embodiment, the gyroscope device 10 may be coupled above a perforating gun 28. Weighted spring positioning devices (WSPD) 14A and 14B are coupled to the perforating gun 28 with indexing adapters 18A and 18B, respectively. The indexing adapters 18A and 18B may allow some degree (e.g., 5°) of indexing between the gun 28 and the rest of the tool string. Based on the desired orientation of the gun 28 with respect to the rest of the string, the gun 28 can be oriented by rotating the indexing adapters 18A and 18B to place the gun 28 at an angular position with respect to the rest of the string 9 so that the gun 28 is at a desired azimuth orientation once the string 9 reaches the target wellbore interval.

According to some embodiments, one or more WSPDs 14 are adapted to steer the string in a natural direction and to reduce the freedom of transverse movement of the orientation string 8 as it is lowered in the wellbore 104. The WSPD 14A is located above the gun 28 and the WSPD 14B is located below the gun 28.

In each WSPD 14, one side is made heavier than the other side by use of a segment with a narrowed section 30 and a gap 32. Thus, in a well having some deviation (e.g., above 1° deviation), the heavy side—the side with the narrowed section 30—of the WSPD 14 will seek the low side of the wellbore 104. Each WSPD 14 also has a spring 16 on one side that presses against the inner wall 106 of the casing 100 to push the other side of the WSPD 14 up against the casing 100. The WSPDs also reduce the freedom of movement of the orientation string 8 by preventing the orientation string 8 from freely rotating or moving transversely in the wellbore 104. The offset weights of the WSPDs 14A and 14B aid in biasing the position of the tool string 8 to the low side of the wellbore 104.

The inclinometer tool 25 includes an inclinometer sonde (such as a highly precise bi-axial inclinometer sonde) attached by an adapter 12 to the gyroscope device 10 below. The inclinometer tool 25 may also include a CCL (casing collar locator) that is used to correlate the depth of the orientation string 8 inside the casing 100. As the orientation string 8 is lowered downhole, the inclinometer sonde provides relative bearing information of the string 8 and the CCL provides data on the depth of the tool string 8. Such data may be communicated to and stored at the surface (or, alternatively, stored in some electronic storage device in the tool string 8) for later comparison with data collected by an inclinometer sonde in the gun string 9. If the relative bearing data of the orientation string 8 and the gun string 9 are about the same, then it can be verified that the gun string 9 is following substantially the same path as the orientation string 8.

Figure 7:
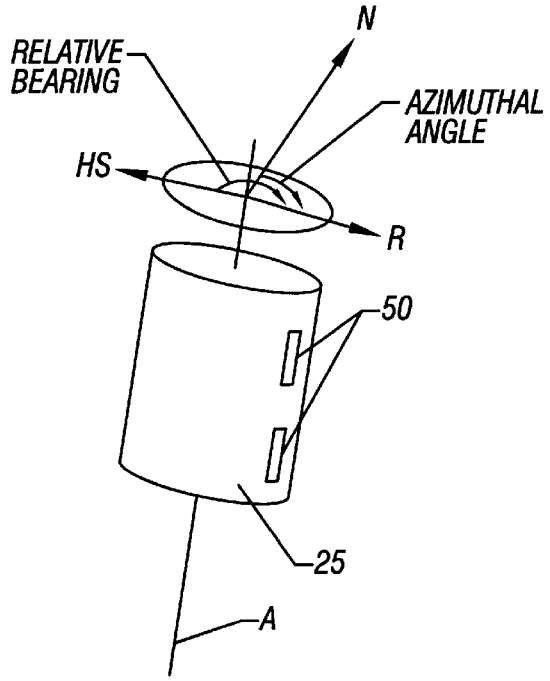
FIG. 7 illustrates relative bearing and azimuthal angles associated with a downhole tool.

Referring to FIG. 7, the azimuthal angle of the tool string 8 or 9 can be defined as the angle between north (N) and a reference (R) in the inclinometer tool 25. The relative bearing angle of each of the orientation string 8 and tool string 9 is measured clockwise from the high side (HS) of the wellbore 104 to the reference (R) in the inclinometer tool 25. In one embodiment, the reference (R) may be defined with respect to one or more longitudinal grooves 50 in the outer wall of the inclinometer tool 25. The positions of the sensor(s) in the inclinometer tool 25 are fixed (and known) with respect to the longitudinal grooves 50. Further, when the string 8 or 9 is put together, the position of the components of the string 8 or 9 in relation to the grooves 50 are also known.

The tool string 8 may be attached at the end of a non-rigid carrier 26 (e.g., a wireline or slick line). In one embodiment, to keep torque applied to the carrier 26 from swiveling the orientation string 8 as it is being lowered downhole, a swivel adapter 24 may be used. The carrier 26 is attached to the string 8 by a carrier head 20, which is connected by an adapter head 22 to the swivel adapter 24. The swivel adapter 24 in one example may be a multi-cable or a mono-cable adapter, which decouples the tool string 8 from the carrier 26 (torsionally). Thus, even if a torque is applied to the carrier 26, the orientation string 8 can rotate independently. Alternatively, the swivel adapter 24 can be omitted if the elasticity of the non-rigid carrier 26 allows the carrier to follow the tool string 8 as it is rotating in traversing the path downhole.

The orientation string 8 is lowered according to a predetermined procedure from the surface. The steps used in this procedure are substantially repeated in the second run of the natural orientation technique to achieve the same positioning in the second run. The orientation of the string 8 as it makes entry into the wellbore 104 is known. The equipment for lowering the string 8 is also known. As the orientation string 8 is lowered downhole, the string naturally positions itself in the hole. According to one procedure, the orientation string 8 is lowered downhole past the well interval defined by the formation zone 102. The orientation string 8 may then be raised back up to the interval and measurements taken using the gyroscope device 10 and inclinometer sonde and CCL 25 to determine the position of the orientation string 8. This procedure can be repeated several times with the orientation string 8 to ensure repeatability of orientation.

There may be cases where the orientation string 8 may not be able to go past the interval defined by the formation zone 102, such as when other equipment are located further below. In such cases, a modified procedure can be used, such as lowering the orientation string 8 into the interval, stopping, making the measurement, and then raising the string.

After measurements have been made, the orientation string 8 is raised out of the wellbore 104. At the surface, before the second run is made, the gyroscope device 10 may be removed. All other components can remain the same as those in the orientation string 8. Like components have the same reference numerals in FIGS. 2A and 2B.

In the tool string 9, the indexing heads 18A and 18B may be rotated to adjust the perforating gun 28 to point in the desired direction. The oriented tool string 9 is then lowered downhole following the same procedure used for the orientation string 8. Because the components of the two strings are substantially the same, the strings will tend to follow the same path. The inclinometer tool 25 (including the inclinometer sonde and CCL) in the gun string 9 can confirm if the string 9 is following about the same path as the orientation string 8. If the comparison of the relative bearing data indicates a sufficiently significant difference in the travel path, the gun string 9 may be pulled out, repositioned, and lowered back into the wellbore 104.

Further, if desired, additional components (such as a sub 27 in FIG. 2B) may be connected in the oriented tool string 9 to make it be about the same length as the orientation string 8. Tests have shown that repeatability of orientation of the strings is good. For example, in a slightly deviated well, such as an about 1° well, variation of about 7° in the orientation of the gun strings was observed over several runs. Any variation below ±10° may be considered acceptable.

In alternative embodiments, the order of the components in tool strings 8 and 9 may be varied. Further, some components may be omitted or substituted with other types of components. For example, the CCL may be part of the gyroscope device 10 instead of part of the inclinometer tool 25. In this alternative embodiment, when the gyroscope device 10 is taken out to form tool string 9, a CCL may be put in its place.

In a variation of the natural orientation embodiment, one run instead of two may be employed to perform oriented downhole operations. If a desired fracture plane or some other desired orientation of a downhole device is known beforehand, an oriented device (such as a perforating gun) may be angularly positioned with respect to the WSPDs 14 at the surface. The WSPDs 14 will likely guide the tool string to a given orientation with respect to the high side of the wellbore. Thus, when the tool string is lowered to the targeted wellbore interval, the oriented device in the tool string will be at the desired orientation. This may be confirmed using an inclinometer, for example.

Figure 5:
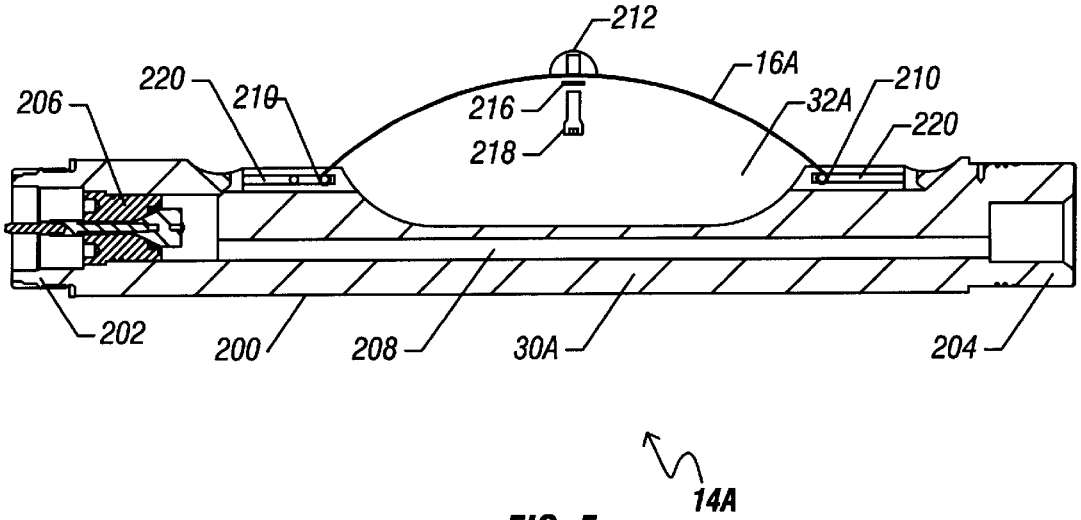
FIGS. 5 and 6 illustrate position devices in the tool strings of FIGS. 2A and 2B.

Referring to FIG. 5, a more detailed diagram of the upper WSPD 14A is illustrated. The housing 200 of the WSPD 14A has a threaded portion 202 at a first end and a threaded portion 204 at the other end to connect to adjacent components in the orientation or tool string 8 or 9. A connector 206 may be provided at the first end to receive electrical cables and to route the electrical cables inside the housing 200 of the WSPD 14A, such as through an inner bore 208.

As illustrated, the upper WSPD 14A includes a segment having the narrowed section 30A and the gap 32A. The eccentering spring 16A that is generally parabolically shaped is attached to one side of the housing 200 of the WSPD 14A. In one embodiment, the spring 16A may be attached to the housing 200 by dowel pins 210. In another embodiment, the spring 16A may be made with multiple layers. A wear button 212 may also be attached to the centering spring 16A generally at its apex. In one example embodiment, the wear button 212 may be attached to the eccentering spring 16A with a bolt 218 and a washer 216. The purpose of the wear button 212 is to protect the eccentering spring 16A from damage due to sliding contact with the inside of the casing 100. In further embodiments, the size of the wear button 212 may be increased or reduced.

A pair of tracks 220 are also defined in the housing 200 in which the dowel pins 210 are received. The dowel pins 210 are moveable in their respective tracks 220 to allow the spring 16A to be compressed toward the housing 200 of the WSPD 14A. Allowing the ends of the spring 16A to be spread along the tracks 220 due to compression as the orientation or tool string 8 or 9 is lowered downhole reduces the likelihood of deformation of the spring 16A.

Figure 6:
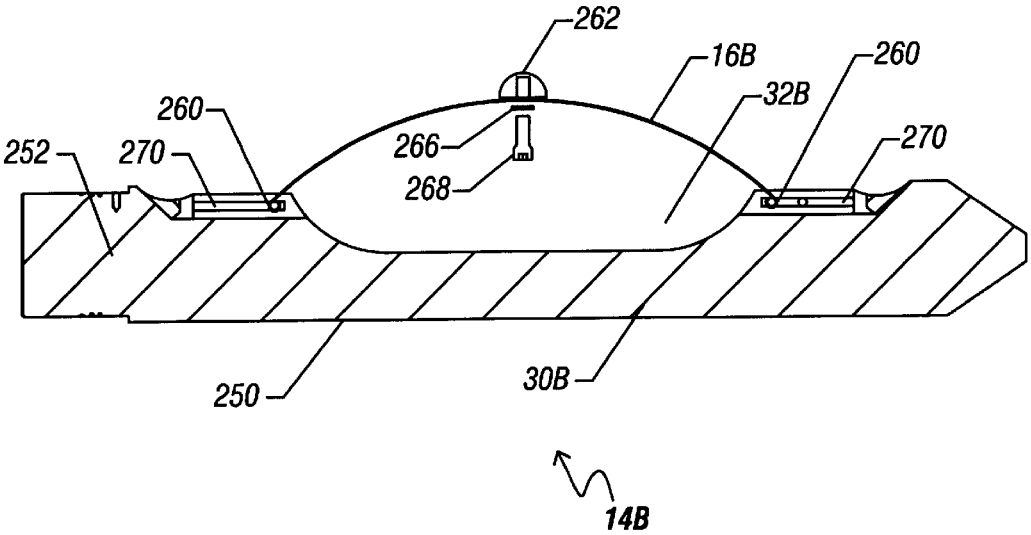

Referring to FIG. 6, the lower WSPD 14B is illustrated. The WSPD 14B includes a housing 250 having a threaded portion 252 at one end to connect to the rest of the orientation or tool string 8 or 9. The housing 250 includes segment having the narrowed section 30B and the gap 32B. The eccentering spring 16B is attached by dowel pins 260 to the housing 250 in side tracks 270. A wear button 262 may be attached to the eccentering spring 16B with a bolt 268 and a washer 266.

Figure 3:
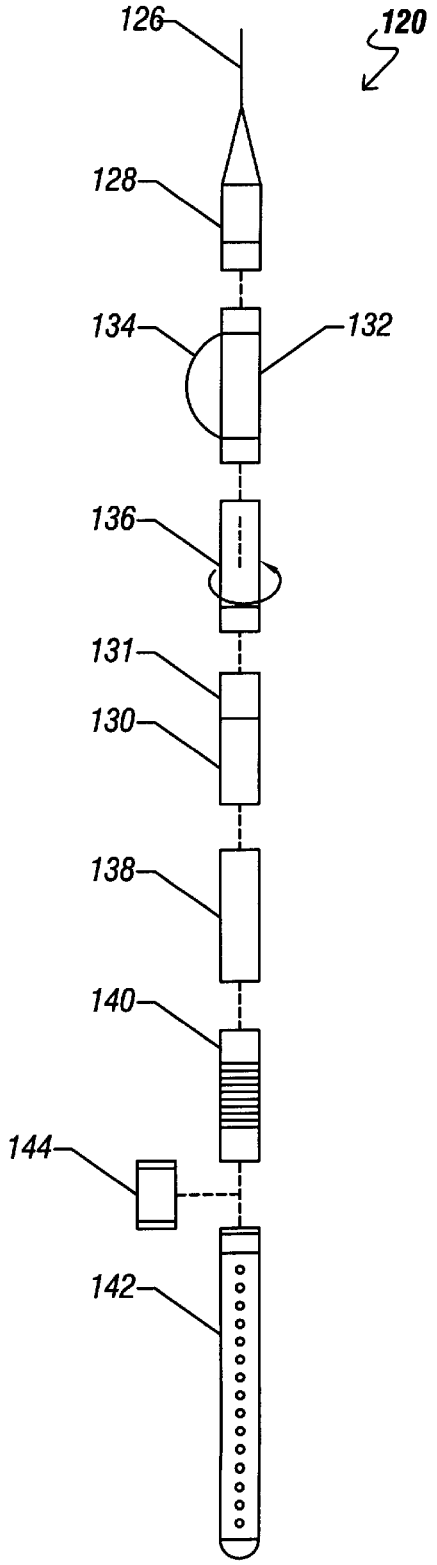
FIG. 3 is a diagram of a tool string according to another embodiment that includes an inclinometer sonde and a motor capable of rotating portions of the tool string.

Referring to FIG. 3, an oriented tool string 120 according to an alternative embodiment of the invention includes components for orienting the string 120 so that multiple runs into the wellbore 104 for orienting tool strings can be avoided. Thus, whereas the tool string 9 of FIG. 2B can be referred to as a passive orienting system, the string 120 shown in FIG. 3 can be referred to as an active system.

An adapter 128 attaches the string 120 to a carrier 126 (e.g., wireline, slick line, coiled tubing, and so forth). An anchor 132 is attached below the adapter 128. In addition, a motor 136 is attached under the anchor 132 that is controllable to rotate a downhole perforating gun 142, for example. The anchor 206 presses against the inner wall 106 of the casing 100 to anchor the tool string 120 while the gun 142 is rotated by the motor 136 with respect to the anchor 132.

A CCL 131 and electronics device 130 may be attached below the motor 136, with the CCL 131 measuring the depth of the string 120 and the electronics device 130 including various electronics circuitry, including circuitry for performing shot detection. An inclinometer sonde 138 is attached below the device 130. Measurements taken by the inclinometer sonde 138, CCL 131, and electronics device 130 may be transmitted to the surface as the tool string 120 is being located into the wellbore 104 to enable a surface operator to control the motor 136 to rotate the gun 142. Based on the data measured by the inclinometer sonde 138, the relative bearing of the tool string 120 can be derived. Based on the measured relative bearing, the motor 136 can be activated to rotate the gun string 120 to the desired azimuthal orientation to perforate in an identified horizontal stress plane (the maximum stress plane). Thus, once the relative bearing of the tool string 120 in an interval is known, and the direction of the stress plane is known, then the tool string can be azimuthally oriented as a function of wellbore inclination. Such an orientation technique for a tool string can be successful in a wellbore having a slight deviation, e.g., as little as a fraction of 1°.

Alternatively, a gyroscope can also be added to the perforating gun string 120 so that the azimuthal orientation of the string 120 can be measured.

To protect the rest of the string 120 from the shock of the gun 142 firing, a shock absorber 140 may be connected between the gun 142 and the inclinometer sonde 138. In addition, a safety device 144 may be included in the string 120 to prevent or reduce likelihood of inadvertent activation of the gun 142. In a modification of the tool string in the FIG. 3 embodiment, the order of the components can be varied and some components may be omitted or substituted with other types of components.

Figure 4:
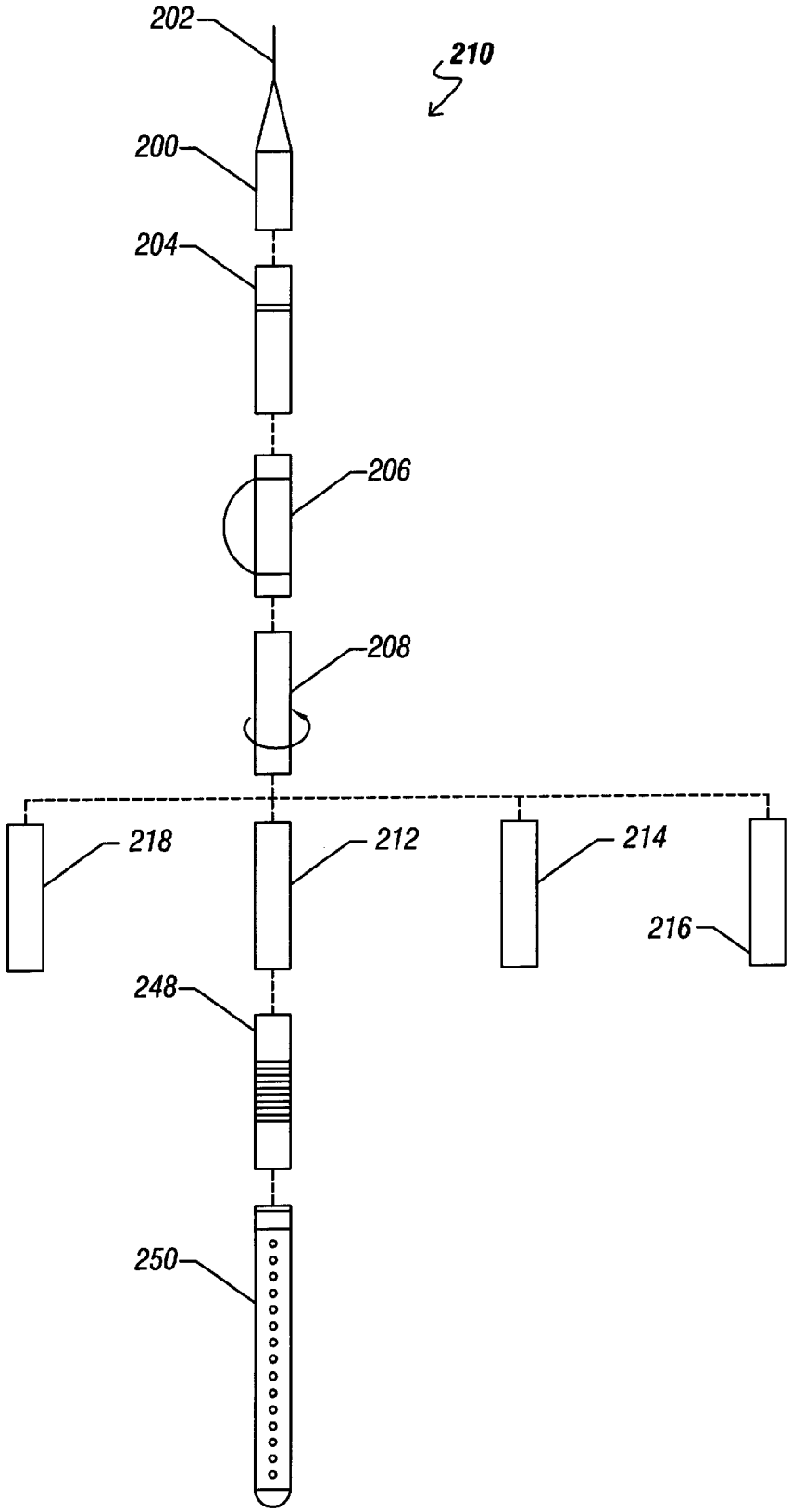
FIG. 4 is a diagram of a modular tool string according to a further embodiment that is capable of connecting to a number of different sondes.

Referring to FIG. 4, another embodiment of the invention includes a modular tool string 210 in which different measurement modules can be plugged into the string to aid in the performance of the desired orientation. The modules may include sondes that are plug-in compatible with the tool string. As with the embodiment of FIG. 3, the modular tool string 210 includes a motor 208 for rotating the gun 250 (or other downhole device) while an anchor 206 fixes a non-rotating portion of the string 210 to the casing 100.

One of the modular sondes may include an inclinometer sonde 218 that may be sufficient for use in a deviated wellbore 104 that has a deviation greater than a predetermined angle, e.g., about 1°. However, if the wellbore deviation is less than the predetermined angle, or it is otherwise desired that a more accurate orientation system be included with the string 210, then additional modular sondes may be added or substituted, including a gyroscope sonde 212. Another sonde that can be used is an electromagnetic flux sonde 214 that may include sensors such as Hall-effect sensors that are sensitive to flux variations to find a submersible pump cable so that the orientation of the tool string with respect to the known position of the submersible pump cable may be determined. The electromagnetic flux sonde 214 uses a electromagnetic field that is propagated about the tool semi-spherically and as the string 210 rotates (controlled by the motor 208) the flux field is affected by the mass of metal (e.g., completion equipment or components such as a submersible pump cable) around it. The measured data can be transmitted to the surface as the tool string 210 is lowered into the wellbore so that a map can be derived of what is downhole adjacent the perforating gun 250. The goal, depending on the specific application, may be to shoot away from or directly into a detected mass of equipment or components.

Another modular sonde that can be used is a focused gamma ray sonde 216. A radioactive source can be associated with one of the downhole component being protected or targeted whether it be another production string or pump or sensor cable. The tool string 210 is then lowered downhole. As the string 210 is rotated, the gamma ray sonde 216 can detect the position of the radioactive source.

Other embodiments are within the scope of the following claims. For example, although the components are described connected in a particular order, other orders are possible. The orientation techniques and mechanisms described can be applied to tool strings other than perforating strings. Additionally, the strings can be lowered downhole using other types of carriers, such as coiled tubing.

Although the present invention has been described with reference to specific exemplary embodiments, various modifications and variations may be made to these embodiments without departing from the spirit and scope of the invention as set forth in the claims.

What is claimed is:

1. A method of orienting a downhole device in a wellbore, comprising:

running an orientation string into the wellbore, the orientation string including a positioning device, a measurement device, and the downhole device;

positioning the orientation string in a predetermined interval in the wellbore;

measuring the azimuthal orientation of the orientation string with the measurement device;

removing the orientation string from the wellbore; and running a tool string including the downhole device into the wellbore such that the tool string follows substantially the same path as the orientation string.

2. The method of claim 1, further comprising orienting the downhole device in the tool string based on the azimuthal orientation measurement made with the orientation string.

3. The method of claim 2, wherein the orienting is performed at the wellbore surface.

4. The method of claim 1, further comprising arranging the orientation and tool strings to have substantially similar components.

5. The method of claim 1, further comprising measuring the relative bearings of the orientation and tool strings as each of them are lowered into the wellbore.

6. The method of claim 5, further comprising comparing the relative bearing measurements to determine if the orientation and tool strings are following substantially the same path.

7. The method of claim 5, wherein the relative bearing measurements are made with inclinometer sondes in the orientation and tool strings.

8. Apparatus for orienting a tool in a wellbore, the apparatus comprising:

a measurement device adapted to measure the azimuthal orientation of the tool; and a positioning device adapted to position the tool as it is lowered into the wellbore, the positioning device enabling the tool to naturally orient itself as the tool traverses the wellbore to a predetermined interval, wherein the measurement device is adapted to measure the azimuthal orientation of the tool after it is positioned in the predetermined interval.

9. The apparatus of claim 8, wherein the positioning device is adapted to prevent free rotation of the tool as it is being lowered into the wellbore.

10. The apparatus of claim 8, wherein the positioning device is weighted on one side such that the weighted side tends to seek the lower side of the wellbore.

11. Apparatus for orienting a tool in a wellbore, the apparatus comprising:

a measurement device adapted to measure the azimuthal orientation of the tool; and a positioning device adapted to position the tool as it is lowered into the wellbore, the positioning device enabling the tool to naturally orient itself once it reaches a predetermined interval, wherein the measurement device is adapted to measure the azimuthal orientation of the tool after it is positioned in the predetermined interval, and wherein the positioning device includes a weighted spring positioning device.

12. The apparatus of claim 8, wherein the measurement device includes a gyroscope.

13. The apparatus of claim 8, further comprising an inclinometer sonde to measure a relative bearing of the tool in the wellbore.

14. An oriented tool for use in a wellbore, comprising:

an oriented device for performing an operation; and a positioning device having at least one spring engageable with the wellbore inner surface and adapted to position the tool as it is lowered into the wellbore, the positioning device enabling the tool to naturally orient itself, the oriented device coupled at a predetermined angular position with respect to the positioning device so that the oriented device is positioned at substantially a desired azimuth orientation when it is lowered to a given wellbore interval.

15. A method of orienting a tool for use in a wellbore, comprising:

identifying a desired orientation of an oriented device in the tool at a given wellbore interval;

angularly positioning the oriented device with respect to a weighted spring positioning device; and lowering the tool downhole, the weighted spring positioning device guiding the tool so that the oriented device is at substantially the desired orientation when the tool reaches the given wellbore interval.

16. The apparatus of claim 8, wherein the measurement device is removable to enable the tool to be run into the wellbore without the measurement device, the positioning device enabling the tool to naturally orient itself without the measurement device.

17. The oriented tool of claim 14, wherein the wellbore inner surface comprises casing, the positioning device engageable with the casing.

18. The oriented tool of claim 14, wherein the positioning device comprises a weighted spring positioning device.

19. The oriented tool of claim 18, wherein the positioning device is heavier on one side than another side.

20. The method of claim 15, wherein the weighted spring positioning device comprises a spring engageable with an inner surface of the wellbore and a side that is heavier than another side.

21. The method of claim 1, wherein orienting the perforating tool comprises orienting a perforating apparatus.

22. The method of claim 1, further comprising using the perforating tool to perforate a portion of the wellbore.

23. The apparatus of claim 8, wherein the tool comprises a perforating apparatus.

24. The tool of claim 14, wherein the oriented device comprises a perforating device.

25. A method of orienting a perforating tool in a wellbore, comprising:

running an orientation string into the wellbore, the orientation string including a positioning device, a measurement device, and the perforating tool;

positioning the orientation string in a predetermined interval in the wellbore;

measuring the azimuthal orientation of the orientation string with the measurement device;

removing the orientation string from the wellbore; and running a tool string including the perforating tool into the wellbore such that the tool string follows substantially the same path as the orientation string.

* * * * *